US007048212B2

(12) United States Patent
Carey

(10) Patent No.: US 7,048,212 B2
(45) Date of Patent: May 23, 2006

(54) SOUND ACTIVATED SAFETY SYSTEM FOR A REDUCTION MILL

(76) Inventor: Alan Carey, 10355 Symphony La., Royal Palm Beach, FL (US) 33411

( * ) Notice: Subject to any disclaimer, the term of this patent is extended or adjusted under 35 U.S.C. 154(b) by 260 days.

(21) Appl. No.: 10/734,487

(22) Filed: Dec. 11, 2003

(65) Prior Publication Data

US 2005/0127217 A1 Jun. 16, 2005

(51) Int. Cl.
*B02C 23/02* (2006.01)
*B02C 23/04* (2006.01)

(52) U.S. Cl. ..... 241/34; 241/32

(58) Field of Classification Search ..... 241/32, 241/34

See application file for complete search history.

(56) References Cited

U.S. PATENT DOCUMENTS 3,082,963 A 3/1963 Gondard
3,540,665 A 11/1970 Snoek
4,202,503 A 5/1980 Parkinson et al.
4,378,094 A 3/1983 Williams
4,449,673 A 5/1984 Cameron
5,230,475 A * 7/1993 Gerner ..... 241/34
5,881,959 A * 3/1999 Hadjinian et al. ..... 241/34
6,354,524 B1 * 3/2002 Nakayama et al. ..... 241/34
6,766,971 B1 * 7/2004 Van Der Beek et al. ..... 241/30

* cited by examiner

*Primary Examiner*—Derris Banks
*Assistant Examiner*—Jason Y. Pahng
(74) *Attorney, Agent, or Firm*—McHale & Slavin PA

(57) ABSTRACT

The present invention provides a sound activated detection system disposed within the conveyor and/or hammer roll area of a reduction mill for detecting unshredable materials fed into the machine. More specifically, an embodiment of this invention comprises a unshredable debris detector disposed in operative relationship in the material input path and includes a transducer, preferably a piezoelectric crystal, acoustically coupled to a sensing surface disposed transversely across a portion of the input path. Alternative embodiments may include one or more accelerometers, microphones, or other vibration or acoustic sensors either alone or in conjunction with the transducer for detecting the unshredable material.

8 Claims, 5 Drawing Sheets

SOUND ACTIVATED SAFETY SYSTEM FOR A REDUCTION MILL

FIELD OF THE INVENTION

The present invention relates generally to the art of reduction mills and more particularly to reduction mills of the type which may be used for such operations as the comminuting of yard and garden waste or refuse into small pieces which are more biodegradable or recyclable. More specifically, the present invention, provides a method and device for preventing and/or minimizing damage to such shredding equipment at the hammer roll area. Still more specifically, to a sound activated system for reversing the direction of movement of the conveyors or pinch rolls feeding debris into the shredding area of the reduction mill to prevent introduction of non-grindable materials into the hammer roll area.

BACKGROUND OF THE INVENTION

Reduction equipment has been known for a number of years and the sizes and applications of such devices vary widely. In the yard and garden equipment industry, reduction mills are becoming more commonplace as states and municipalities mandate the composting of yard and garden waste, or as operators of composting sites find that their operations can be run more efficiently if waste such as branches, fallen trees, and the like are comminuted before the material is put into windrows or piles. In the refuse industry reduction mills are also becoming commonplace as the Federal and State governments mandate strict requirements for landfills. The smaller pieces resulting from such operations biodegrade more quickly under suitable moisture and oxygen conditions and the volume required for the ultimate disposal of the material is also reduced.

Such machines have included a generally rectangular collection hopper which can be loaded by front end loaders and the like with debris to be comminuted. The floor of the bin is a first endless conveyor adapted to move the debris from a rear portion to the opposite end of the machine. Prior machines have also included an upper conveyor, inclined at an acute angle with respect to the floor conveyor, or an upper feed roll adapted to assist in moving material toward the nip formed between the two conveyors. A rotating hammer mill has been located at the outlet of the nip to receive material being moved by the conveyors. The hammer mill includes a rotating hammer roll having plurality of hammer knife elements which pass in close proximity to a stationary cutting surface, all as is well known in the comminuting art for dividing the material into fine pieces which are discharged at the rear of the machine. Various modifications which are not relevant to the present invention include providing screens on the rear of the hammer mill to cause particles to stay in the shredding section for a longer period of time so that the average particle size can be reduced, and various devices for directing the discharge to a desired outlet location, which could be a windrow, a pile or the like.

In such prior equipment, one frequently encountered problem has been the introduction of unshredable material into the machines when large bunches of the debris are being forced by the two conveyors toward the hammer roll. Unshredable material may include stones, concrete or metal hidden in the debris. Due to a lack of suitable equipment to detect such unshredable material in the prior art machines, unshredable material has resulted in serious and costly damage to the equipment. Removal of the unshredable material from the hammer mill area necessarily requires the equipment to be completely shut down so that the conveyor and hammer may be cleaned out manually. Only after the debris has been cleaned from the machine can the damage be assessed and repaired. Such operations result in reduced efficiency and substantially increased operating costs for the equipment, and a system which would overcome this problem would represent a substantial advance in this technology.

Attempts at designing the equipment to withstand introduction of the unshredable material have met with minimal success. These devices generally center around screens or spring loaded by-pass gates.

For example, U.S. Pat. No. 3,082,963, teaches a hammer grinder. The device includes a vertical supply passage above the hammer roll and a semi-cylindrical grid below the hammer roll. A casing is located adjacent to the supply passage for collecting unshredable material. The unshredable material is removed from the hammer grinder through an opening in the lower part of the casing.

U.S. Pat. No. 3,540,665, teaches a scrap breaking device. The device includes a supply passage for the scrap positioned above the hammer roll and a semi-cylindrical grid below the hammer roll which forms a partition between the hammer roll and the a discharge passage. The scrap first enters the supply passage via a conveyor and falls down into the hammer roll area. The objects which are not broken are thrown upward to a grid positioned above the conveyor. Objects remaining on the grid can be removed manually after the hammer roll is shut down.

U.S. Pat. No. 4,378,094, teaches a material reducing mill. Material is delivered to the mill via a conveyor which allows the material to fall onto the rotating hammer roll. The device is also provided with a by-pass gate positioned adjacent to the fall of material. The by-pass gate is manually operable to direct unshredable material away from the hammer roll. When an operator hears a unshredable object strike the hammer roll a lever is actuated to move a gate into an open position, thereby allowing the material in the area to be by-passed around the hammer roll assembly. The result is that the chute formed thereby will direct a quantity of material, including the unshredable material, into the by-pass passage. Concurrently with the operation of the by-pass gate, the drive for the conveyor is reversed so that the by-passed material can be directed into a container.

U.S. Pat. No. 4,449,673, teaches a reduction mill having a rotating hammer roll and a hydraulically displacable grate and by-pass door assembly. The grate assembly being pivotally displacable by power means, as a single unit, from the hammer roll portion to achieve ready access to the grate assembly for reversal or replacement of worn sections. The by-pass door is pivotally displacable to a first position which permits quick, safe and efficient removal of unshredable materials from the product stream of the reduction mill without stopping hammer roll rotation. The pivotal displacement of the by-pass door is selectively powered by the same power means or unit which pivotally displaces the grate system for access to the hammer roll and grate assembly.

Other devices are aimed at allowing easy access to replace broken or worn components instead of preventing unshredable material from entering the hammer mill the device. For example, U.S. Pat. No. 4,202,503, teaches a hammer mill comprising a housing and mounted within the housing a rotor and a breaker and screening assembly which cooperates with the rotor is constructed so that the breaker and screening assembly may be angularly displaced between an operative position adjacent the rotor and a servicing position at which access may be had to the breaker and screening assembly from outside the casing.

Accordingly, what is lacking in the prior art is a cost effective safety system for a reduction mill that is capable of effectively preventing or minimizing damage caused to the mill components by the introduction of unshredable material. The safety system should achieve objectives such as quick response and reliable performance. The safety system should include packaging flexibility for installation on various new and pre-existing hammer mill configurations including retrofitting onto pre-existing hammer mills with minimal modification.

SUMMARY OF THE INVENTION

The present invention provides a sound activated detection system disposed within the conveyor and/or hammer roll area of a reduction mill for detecting unshredable materials fed into the machine. More specifically, an embodiment of this invention comprises a unshredable debris detector disposed in operative relationship in the material input path and includes a transducer, preferably a piezoelectric crystal, acoustically coupled to a sensing surface disposed transversely across a portion of the input path. Alternative embodiments may include one or more accelerometers, microphones, or other vibration or acoustic sensors either alone or in conjunction with the transducer for detecting the unshredable material. The present invention further features a conveyor system wherein the conveyor(s) are automatically reversed for a predetermined amount of time when a unshredable object is detected. The reversal of the direction of movement of the endless conveyor(s) allows the unshredable object, which could damage the equipment, to be removed from the waste material.

The unshredable detector incorporates means for selecting the detected "unshredable" signal from spurious signals or extraneous false vibrations in order to actuate a threshold means. More specifically, an embodiment of the invention incorporates acoustic isolation means coupled to the sensing surface to suppress or isolate extraneous false acoustic vibrations of the reduction mill of the same character as the "unshredable" detection signal from the sensing device; whereas, a further embodiment of this invention includes a circuit having at least one filtering means for selecting the detected stone signal from the spurious signals of the same character as the detected stone signal. In addition, an embodiment of this invention includes means for controlling the direction of flow of material and unshredable debris gathered therewith such that all of the material and foreign objects, conveyed through the mill are directed towards the sensing device to impact therewith to assure detection of all of the unshredable foreign objects mixed therewith.

Accordingly, it is an objective of the present invention to provide an acoustic unshredable material detection system for a reduction mill.

Yet an additional objective of the present invention to provide an acoustic array that is capable of detecting unshredable material located within the material flow through a reduction mill.

It is a further objective of the present invention to provide a controller capable of receiving an electrical signal from an acoustic sensor and transmitting an electrical signal to a solenoid.

A still further objective of the present invention is to provide a first acoustic array positionable within a reduction mill.

Another objective of the present invention to provide a sounding plate for the first acoustic array.

Yet another objective of the present invention is to provide a kit for a reduction mill capable of detecting unshredable material within the debris flow through the reduction mill to prevent and/or reduce damage to the hammer roll that is simple to install and which is ideally suited for original equipment and aftermarket installations.

Yet another objective of the present invention is to provide a kit for a reduction mill capable of detecting unshredable material within the debris flow through the reduction mill that can be inexpensively manufactured and which is simple and reliable in operation.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
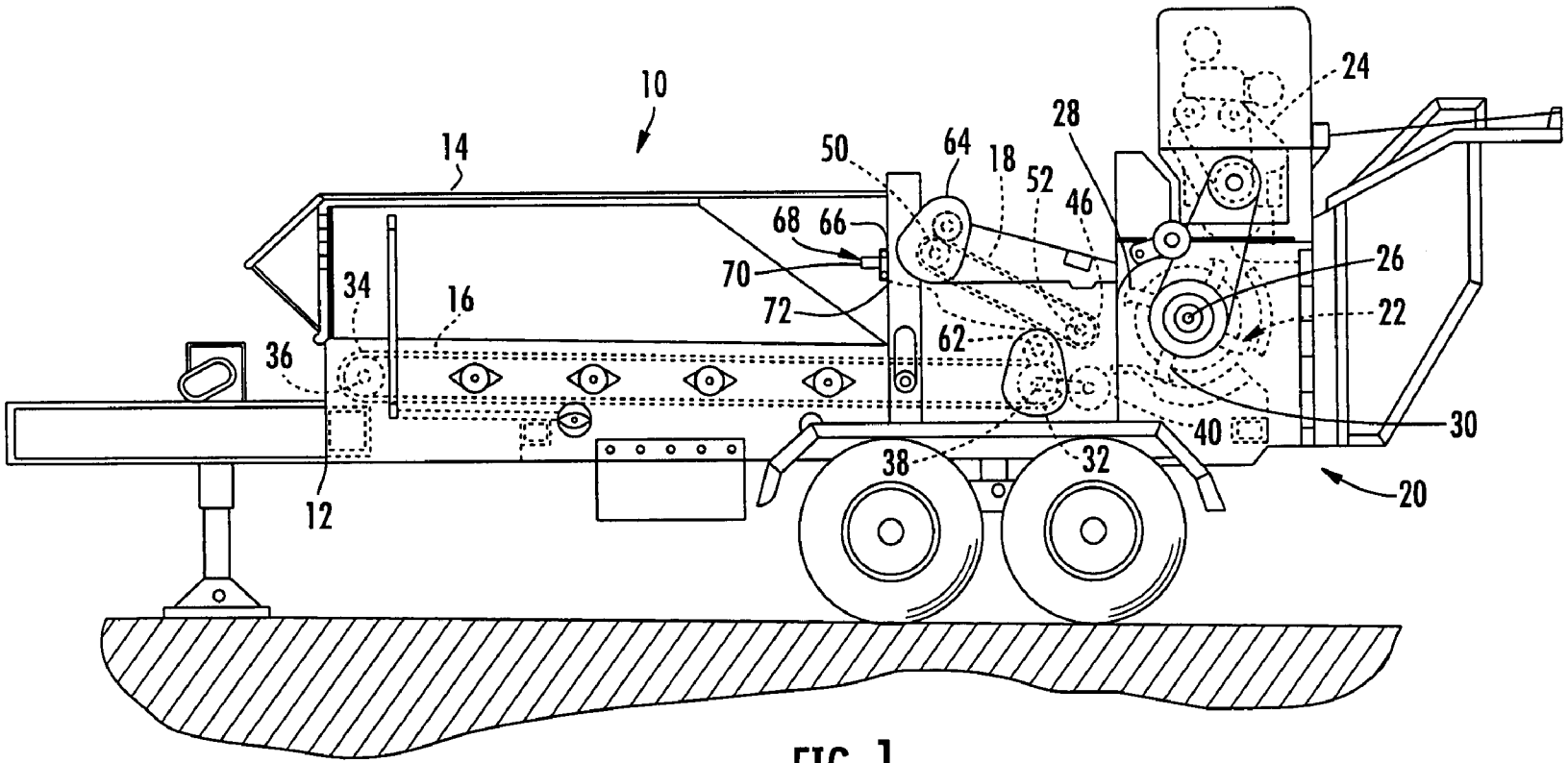
FIG. 1 is a side schematic illustration of a mobile waste shredder according to a preferred form of the present invention showing the overall layout of the equipment.

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

In the following description, a mobile hammer mill is discussed. As illustrated generally in FIGS. 1–3, a mobile hammer mill designated generally as 10 is configured to receive and comminute waste including brush, branches, trees, refuse and the like. The mobile hammer mill 10 includes a frame 12 on which is mounted a hopper 14 for receiving waste material which may be dumped into hopper 14 by a front end loader or other conventional methods.

Disposed along the floor of hopper 14 is a lower or floor conveyer 16 which cooperates with an upper feed roll 17 (FIG. 2) or upper conveyor 18 (FIG. 3) to deliver the waste to a hammer section designated generally as 20.

Hammer section 20 includes a rotatable hammer roll 22 driven by an engine 24. Hammer roll 22 is mounted on a shaft 26 and includes a plurality of fixed or pivotable hammer knife elements 28 which pivot outward into proximity with stationary cutting bars 30 when hammer roll 22 rotates. As waste material moves into the hammer section 20, the waste material is sheared into pieces between the moving hammers 28 and the stationary cutting bars 30.

Figure 2:
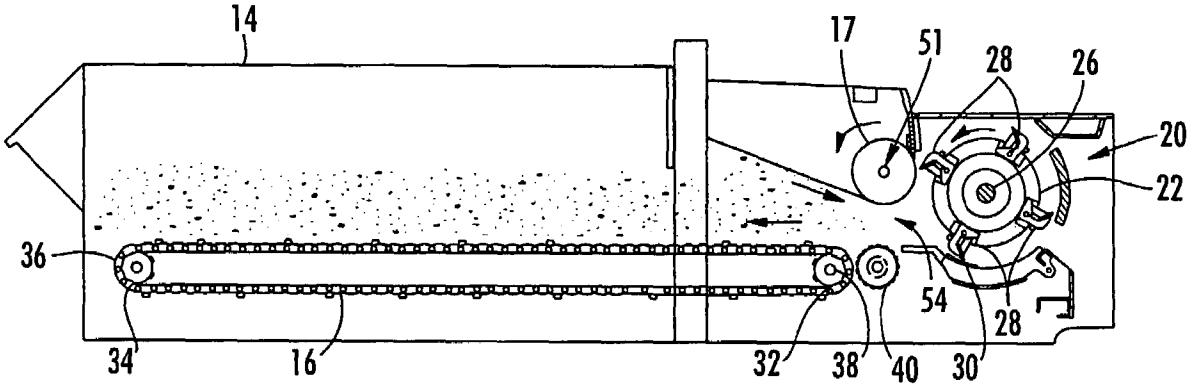
FIG. 2 is a schematic illustration of one type of a conveyor system capable of utilizing the present invention, arrows indicating normal direction of travel and illustrating waste material approaching the nip area of the conveyor.
Figure 3:
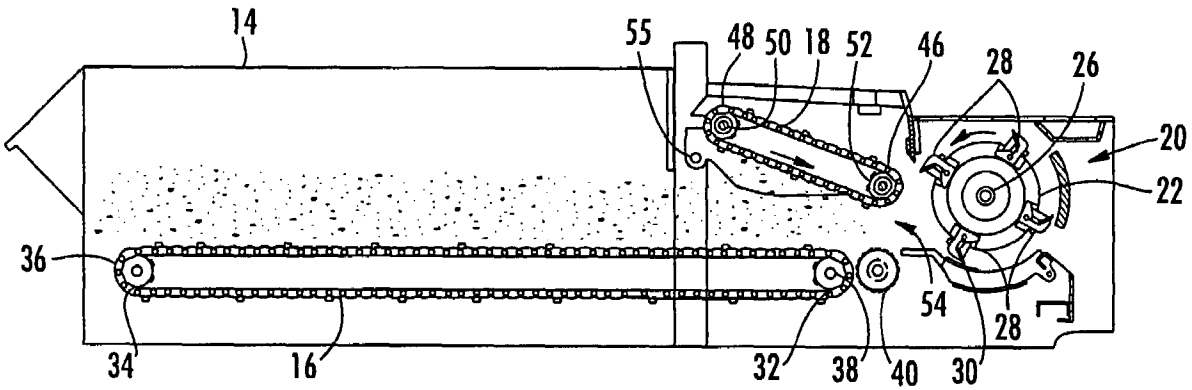
FIG. 3 is a schematic illustration of a dual conveyor system capable of utilizing the present invention, arrows indicating normal direction of travel and illustrating waste material approaching the nip area of the conveyors.

Waste material is supplied to hammer section 20 by at least a lower conveyor 16 and may include an upper feed roll 17 (FIG. 2) or upper conveyer 18 (FIG. 3). The lower conveyer 16 is an elongated endless conveyer having a first end 34 disposed towards the hopper 14 and a second end 32 disposed towards hammer section 20. Lower conveyer 16 rotates around an idler gear shaft assembly 36 located at its second end 32 and is driven by a driving gear shaft assembly 38 located at its first end 34.

A feed roll 40 is positioned between lower conveyer first end 32 and hammer mill 22. Feed roll 40 receives waste delivered from lower conveyer 16 and assists in forcing the waste into hammer section 20. Preferably, feed roll 40 is driven by a roller chain 42 connected to a sprocket 44 mounted on driving gear shaft 38.

The optional upper feed roll 17 is disposed in proximity to hammer section 20. Upper feed roll 17 driven by a driving gear shaft assembly 51 forms a narrower nip area 54 through which material passes before entering hammer roll 22. As shown in the right side schematic view of FIG. 2, during normal operation upper feed roll 17 rotates in a counterclockwise direction (as viewed from the right) while lower conveyer 16 feed roll 40 both rotate in the clockwise direction to cooperate in forcing the waste material into hammer mill 22.

The optional upper conveyer 18 (FIG. 3) includes a first end 46 disposed in proximity to hammer section 20 and a second end 48 disposed generally away from hammer section 20. Conveyer 18 is an elongated endless conveyer driven by a driving gear shaft assembly 50 disposed at second end 48 and further rotating about an idler gear shaft assembly 52 disposed at first end 46. The upper conveyer 18 is preferably oriented so that it forms an acute angle with lower conveyer 16 wherein first end 32 of lower conveyer 16 and first end 46 of upper conveyer 18 form a narrower nip area 54 through which material passes before entering hammer roll 22. As shown in the right side schematic view of FIG. 3, during normal operation upper conveyer 18 rotates in a counterclockwise direction (as viewed from the right) while lower conveyer 16 and feed roll 40 both rotate in the clockwise direction to cooperate in forcing the waste material into hammer mill 22.

In the embodiments illustrated in FIGS. 1–3, floor conveyer 16 is driven by a hydraulic motor (not shown) by conventional means well known in the art. Similarly, upper feed roll 17 or conveyer 18 are driven by a hydraulic motor (not shown) connected to driving gear shaft assembly 50 by conventional means well known in the art. In general, engine 24 drives a hydraulic pump of conventional configuration to supply pressurized fluid to the hammer mill hydraulic system to control the speed and direction of the conveyors 16, 18, and/or feed rolls 17, 40 as well as the hammer roll 22. The control circuitry used to control the hydraulic system is conventional circuitry as would be used by one of ordinary skill in the art to control solenoid valves. Of course, the conventional circuitry can be modified according to the type of valves, location of valves or type of switches utilized throughout the system. Preferably, a manual override switch is also connected into the control circuitry so that the lower conveyor can be reversed manually as well as automatically. In a most preferred embodiment the control circuitry also includes a self-check circuit (not shown) capable of assuring electrical connection between the present invention safety device and the pre-existing electric controls for the reduction mill.

Figure 4:
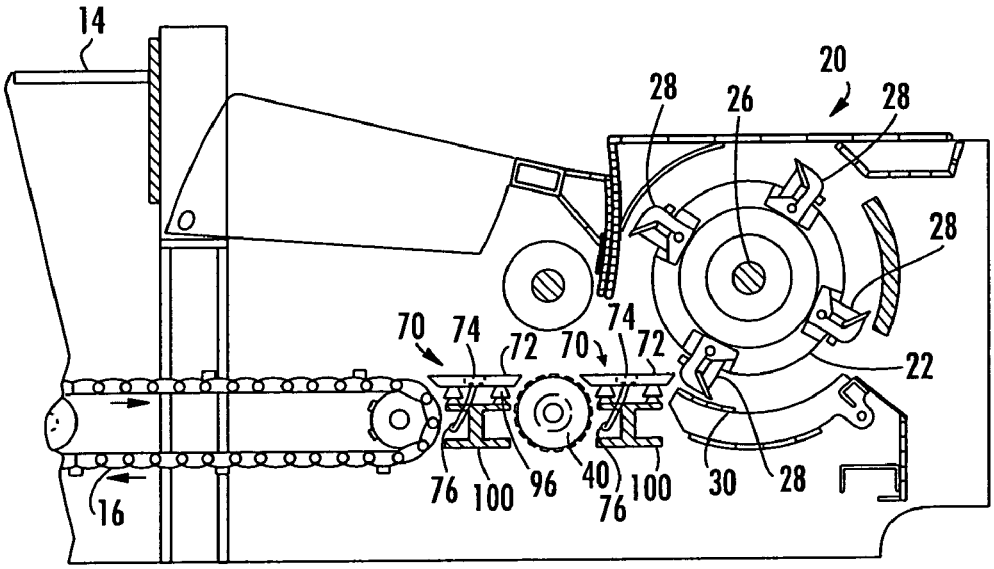
FIG. 4 is a partial side view illustrating one embodiment of the present invention.
Figure 5:
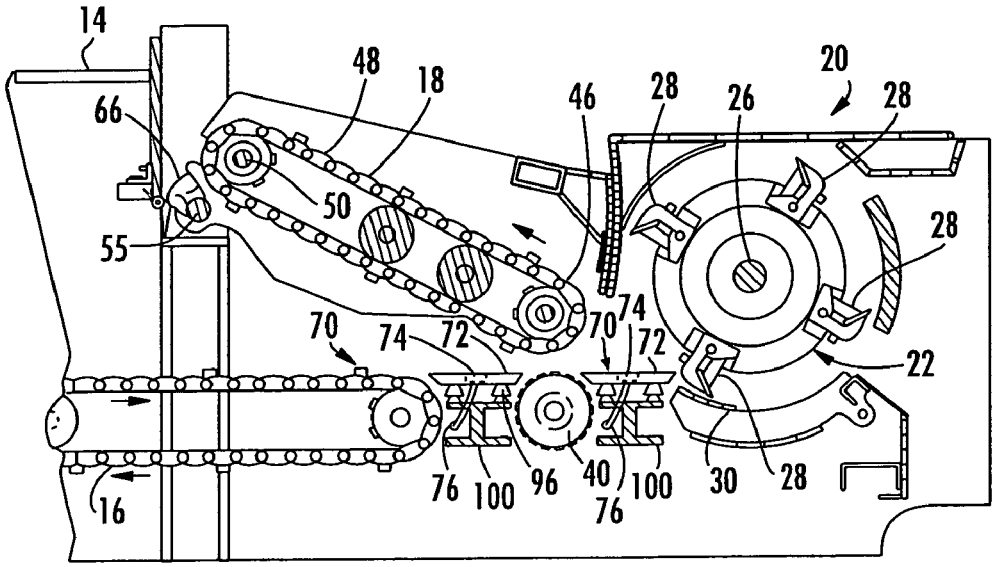
FIG. 5 is a partial side view illustrating one embodiment of the present invention.

FIGS. 4 and 5 depict, in part, the apparatus comprising the present invention. An acoustic sensing device 70 including a sensor bar 72, preferably a steel bar or plate, and an acoustic sensing transducer 74 attached to the bar is disposed generally across the width of the floor of the conveyor 16. The acoustic sensing device 70 may be positioned between the conveyor 16 and the lower feed roll 40, between the lower feed roll 40 and the hammer area 20 or adjacent to any of the stationary plates 30. The transducer 74 typically, a disk shaped piezoelectric crystal is attached to the sensing bar 72 or inserted in a contoured recess located in the backside of the bar, away from the material flow, and is secured therein in any appropriate manner. In response to material including unshredable debris, e.g. stones, metal and the like, striking the upper surface of the sensing bar 72 causing acoustic vibrations therein, the piezoelectric crystal or transducer 74 detects the acoustical vibrations and generates electrical signals, along lines or circuit leads 76. The frequency and amplitude of the electrical signals vary as a function of the characteristic of the acoustic vibrations in the bar as a result of shredable material and/or unshredable debris impact. The electrical signals, moreover, are coupled to appropriate circuit means for detection of the unshredable debris disposed in the shredable material.

Figure 6:
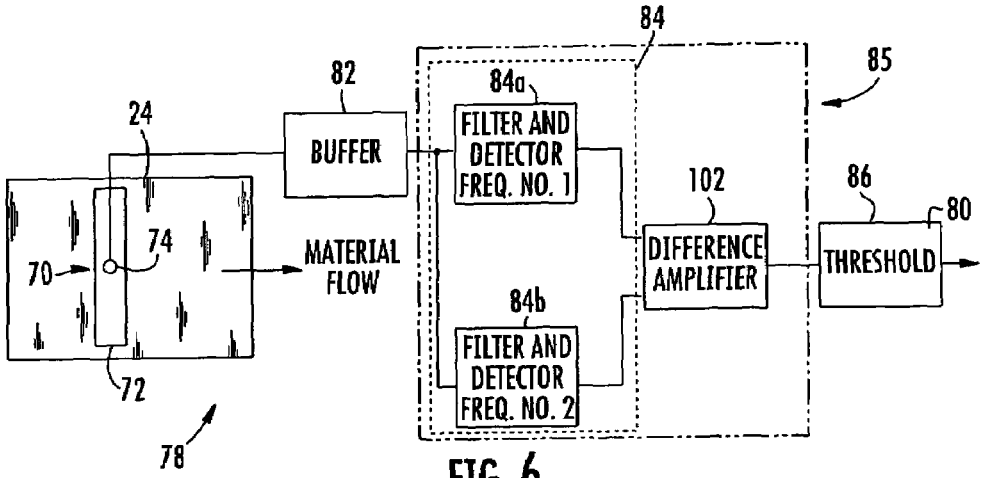
FIG. 6 is a schematic in block form illustrating one embodiment of the present invention.

Referring now to FIG. 6, a processing circuit 78, illustrated in block diagram form, provides a signal 80 indicative of the presence of unshredable debris within the shredable material. The circuit 78 includes a buffer circuit 82 which receives the electrical signals from the piezoelectric crystal in response to vibrations of the bar 72 and provides a properly matched interface between the remainder of the processing circuitry and the transducer 74. From the buffer circuit 82, the signals are coupled to a bandpass filter circuit 84. The acoustic sensing bar 72 has a spectrum of line frequencies to which it is mechanically resonant, wherein these frequencies are excited by impact of material against the bar. It should be noted, however, that these line frequencies do not stand out, because the bar is well damped, as explained hereinbelow, and because the excitation arises from many incoherent impulses.

Figure 9:
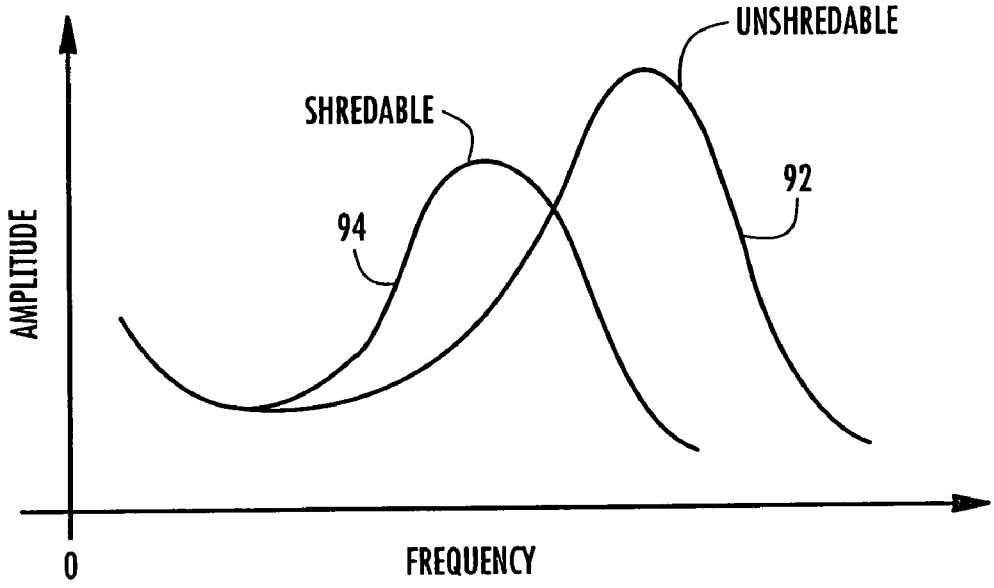
FIG. 9 is a graphic illustration of the characteristic amplitude as a function of frequency for shredable material and unshredable debris impacting the acoustic sensing device of the instant invention.

The frequencies are distinguishable only in a broader sense, which results from the fact that the impact of a hard surface material is able to generate higher frequency sound. This results in the acoustic energy from impact being concentrated into different bands, with the distribution of energy of unshredable debris impacts being at a higher frequency than the energy distribution of softer surface materials such as wood. FIG. 9 is a graphic illustration of the characteristic amplitude as a function of frequency for shredable material and unshredable debris impacting the bar. As shown, the characteristic frequencies 92 excited by unshredable debris, although generally of greater frequency than the frequencies 94 excited by a softer surface such as wood or leaves, are not rigidly fixed within the frequency spectrum. Accordingly, the value of the resonant frequencies for a particular sensing device should be measured so that the center frequency of the bandpass filter 84 may be aligned to envelop the greater or higher in value resonance frequencies induced by the hard object or unshredable debris to be detected. In addition, the bandwidth of the bandpass filter 84 is also significant and should be chosen to best match the time characteristics of the impact signal. A wideband allows greater response to initial high amplitude signals induced immediately after impact, whereas a narrow bandwidth has the effect of averaging the response over longer duration. Accordingly, the bandwidth of the bandpass filter circuit 84 is chosen therebetween depending upon the characteristics of the signals 92 transmitted by the sensing bar 72 in cooperation with the piezoelectric crystal transducer 74. The bandpass filter circuit 84 attenuates all signals not falling within the passband, whereas, those signals whose frequencies fall within the passband and thereby initially represent the detection of unshredable debris in the conveyor area or the hammer area are coupled to a threshold comparator circuit 86 (FIG. 6). The threshold comparator circuit 86 compares the amplitude of the signal from the bandpass filter 84 with the amplitude of a preselected or predetermined threshold value deemed to be indicative of unshredable debris and generates the signal 80 indicative of the presence of the unshredable debris when the threshold value is exceeded. The actuating signal 80 may be coupled to any suitable actuation device such as warning means, lights or alarms, or conveyor reversing means such as a solenoid activated hydraulic valve well known in the art.

As indicated above, spurious or false signals of the same character or characteristics as the unshredable debris signals to be detected may be induced within the hammer mill, and more specifically, within the acoustic sensor 70 due to the interaction of, for example, the moving mechanical parts within the reduction mill or due to noises of similar character as a unshredable debris impact conducted to the sensor bar from outside the flow of material within the hopper and conveyor areas. These spurious or false signals may be isolated or suppressed as indicated herein such that exclusive detection of unshredable debris within the reduction mill is assured.

An embodiment of this invention comprises means coupled to the sensor of this invention to obviate or lessen the effect of spurious acoustic signals, which may be induced in or excited by the bar, and which have the same character as the signals of a stone hitting the bar 72, thereby ensuring that only unshredable debris impacts on the sensor bar are recognized. The preferred embodiment of the instant invention includes vibration isolators 96 shown in FIGS. 4 and 5, for example, which are essential in isolating the bar 72 from spurious signals that have the same character as an unshredable debris signal. The vibration isolators 96 are coupled between the acoustic sensor 70 and the reduction mill to suppress or isolate the sensor from the spurious signals generated within the reduction mill which otherwise would be coupled to the transducer 74.

Referring to FIGS. 4 and 5, each end of the acoustic sensor 70 and specifically the bar 72 is secured, for example, to a mounting bracket 100, through the vibration isolators 96 such as Barry Cup-Mount C-2040-T6 isolators produced by the Barry Controls Corporation. The entire sensing device 70 and more particularly the brackets 100 are secured to the frame or housing of the reduction mill such that the sensing bar 70 is disposed in the plane of the floor of the lower conveyor as shown in FIGS. 4 and 5, with no physical contact between the sensing device and the conveyor. Accordingly, the vibration isolators 96 acoustically isolate the sensing device from the bracket and more specifically from the reduction mill and thereby prevent spurious or false signals from being induced within the bar 74. Although a space or air gap will exist along the transverse extent of the bar in the floor of the conveyor through which some material may be lost, this space or gap may be filled with an acoustically isolating material or spacer to prevent material loss or deterioration of the acoustic isolation or more importantly the deterioration of the signal indicative of the presence of the unshredable debris.

Figure 7:
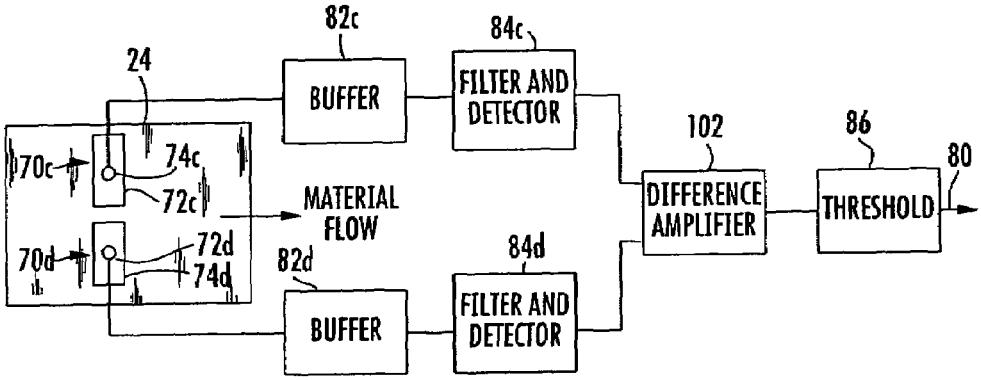
FIG. 7 is a schematic in block form illustrating an alternative embodiment of the present invention.
Figure 8:
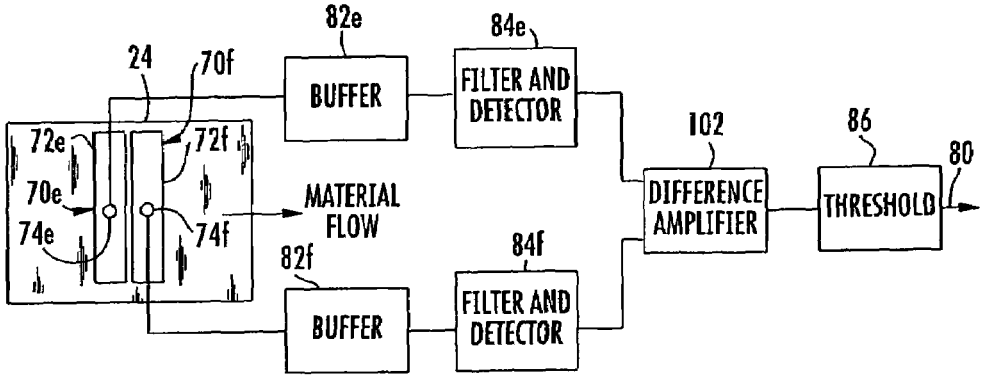
FIG. 8 is a schematic in block form illustrating an alternative embodiment of the present invention.

Referring to FIGS. 6, 7 and 8, three variations of electronic isolation means coupled to the acoustic sensor 70 to obviate the effect of signals of the same character as the unshredable debris impacting signal to be detected are illustrated for improving the performance of the sensor. The electronic isolation means illustrated allows the signal from the sensor to discriminate between sounds that are truly unshredable debris and those other noises induced or excited in the bar and, thereby, ensure that only the unshredable debris impact on the sensor bar is recognized. In this manner, false alarms are substantially eliminated. Specifically, the electronic differencing technique illustrated in FIGS. 6, 7 and 8 provide filtering schemes which sense the presence of unshredable debris and lessen the effects of spurious noise or false signals. In the embodiment of FIG. 6, the apparatus of this invention including the electronic isolation means is illustrated in block diagram format comprising a buffer circuit 82 [it being realized that like numbers are utilized to indicate similar or like circuits or elements throughout] coupled to the sensor 70 disposed in the conveyor area. The buffer circuit provides a properly matched interface between the remainder of the processing circuitry and the transducer 74. The buffer circuit 82 is coupled to a pair of parallel filter and detector circuits 84*a* and 84*b*, respectively. As noted hereinabove and illustrated in FIG. 9, unshredable debris impacts exhibit a different distribution of amplitude with frequency than does the shredable material, which has a spectrum of resonant frequencies, substantially distinctly separated from each other. Thus, the buffer circuit of FIG. 6 is coupled to a parallel pair of filter and detector circuits 84*a* and 84*b* each aligned with a different resonant frequency and each performs a bandpass filter function. The pass band of the filter and detector circuit 84*a*, for example, is selected to include one frequency band such as that induced by the unshredable debris, for example, 92 of FIG. 9, while the pass band of filter and detector circuit 84*b* is selected to include a second characteristic frequency such as that induced by the impact of shredable material, 94 of FIG. 9. The selected characteristic frequency includes the maximum amplitude frequency of the respective unshredable debris and shredable material signals. The detector circuit portion of filter and detector circuits 84*a* and 84*b* rectifies the input signals thereto providing an envelope of the signals. The output signals from both filter and detector circuits which may comprise the envelope of the input signals thereto, are suitably weighted and coupled to a difference amplifier 102. The balance is such that the signal in the lower frequency pass band of the shredable material noise dominates and holds the setting of the differential amplifier or comparator 102. When unshredable debris strikes the bar, however, the signal in the higher frequency pass band momentarily becomes larger causing the amplifier to switch state. The output is coupled to the threshold circuit 86 which gives the alert or warning indicative of the presence of unshredable debris in the waste material when the amplitude of the output from the difference amplifier exceeds a preselected value. The difference signal developed in the difference amplifier or comparator 102 provides a sensitive indication of the presence of unshredable debris in the waste material which eliminates or obviates the effects of the unwanted spurious noise signals, and thereby, reduces false alarms from the noise signals.

The embodiments of the electronic differencing techniques of FIGS. 7 and 8 include a plurality of separate sensing systems having separate buffer and filter circuits respectively coupled to a difference amplifier such that the difference signal can be made sensitive to unshredable debris signals in one bar over and above the general sound level, of the other bar, and isolation of the spurious sounds may be readily detected. For example, in FIG. 7, two sensing systems 70*c*, 70*d* are disposed in parallel, i.e., in side by side relation, transverse, across the floor of the conveyor area each comprising a bar 72*c*, 72*d* and transducer 74*c* and 74*d*, respectively. Each sensor monitors a portion of the floor of the conveyor area and the combination thereof spans the entire width of the conveyor such that unshredable debris may contact one bar but not the other. Each sensor, moreover, comprises a buffer and a filter and detector circuit 82*c*, 82*d* and 84*c* and 84*d*, respectively. The output from the filter and detector circuits are each coupled to a difference amplifier 102 as previously indicated with respect to FIG. 6. This electronic circuit isolation means can then be made sensitive to vibrations in the bars which occur in one bar and not the other, but those vibrations which occur in both bars at substantially the same time and reach the differential amplifier with the same characteristic frequencies may then be isolated as being an induced, false, signal producing no output from the difference amplifier. Accordingly, only the strong accentuated impact sound of unshredable debris hitting one of the bars 74*c* or 72*d*, respectively, will be passed by the difference amplifier through a threshold circuit 86 as previously indicated to provide the sensitive indication of the presence of unshredable debris in the gathered shredable material.

Likewise, in FIG. 8, two sensors 70*e* and 70*f*, respectively, each comprise a bar 72*e* and 72*f* in series relation, that is, one in front of the other each spanning the floor of the conveyor area and each comprising a transducer 74*e* and 74*f*. Each sensor includes a buffer 82*e* and 82*f* and a filter and detector circuit 84*e* and 84*f*. The output of each sensor is coupled from the filter and detector circuit to a difference amplifier 102 and a threshold circuit 86 as explained hereinabove to provide the signal 80 indicative of unshredable debris in the hammer area. It is appreciated that the sensor means of FIGS. 7 and 8 are arranged such that the impacting signal of unshredable debris on one of the associated sensor bars is accentuated whereas extraneous, spurious or false signals are suppressed, as they are induced in both bars in each figure with substantially the same character or characteristic frequency as the signal to be detected and are washed out by the difference amplifier 102.

Thus, the sensing bars in both figures are arranged so that the unshredable debris mixed with the shredable material in the conveyor area will impinge or impact on one or the other of the sensor bars, creating the impacting signal to be detected in the respective circuit, whereas in the other circuit no signal is generated. The difference amplifier 102 detects this difference and accentuates the detected signal by passing only this signal to the threshold 86. In like manner any spuriously induced vibrations will induce signals in each sensor and associated circuitry at substantially the same instant in time and will be cancelled in the difference amplifier. It should also be noted, that the electronic components depicted within block 85 of FIG. 6 may be substituted for the components designated 84*c* and 84*d* in FIGS. 7 and 84*e* and 84*d* in FIG. 8.

In the operation of the preferred embodiment of this invention, the waste material including unshedable debris is conveyed by the lower conveyor and is fed into the hammer area 20. The flow of material impacts the sensor 70 and more specifically the sensor bar 72 from which the acoustical signals generated therein are detected by the transducer 74 which provides electrical impacting signals in response thereto. More particularly, isolation means, for example, the vibration isolators 96 indicated herein isolates the sensor 70 and eliminate the effects of noise from within and outside of the hammer mill. The vibration isolators enable the detection of virtually all of the unshredable debris by accentuating the impacting signal over the background. An alternative embodiment of this invention may further includes deflector means to direct the flow of the material within the conveyor area such that impacting contact with the bar is assured. It will be appreciated that, as the present invention is disposed in the conveyor area of the hammer mill, it may also be incorporated into the hammer roll area 20 itself wherein the sensor(s) 70 will detect impacts of unshredable material with the hammers 28 and/or the stationary cutting bars 30.

When the transducer 74 exceeds a certain predetermined level, acoustic sensing device 70 will provide an output to the control circuitry which, in turn, will activate the appropriate valves to reverse, preferably, lower conveyor 16. The acoustic sensing device may also provide outputs to the control circuitry to stop the hammer roll 22 and/or initiate audible or visual warnings.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. In a reduction mill susceptible to damage by a non-frangible foreign object included within reducible material fed into the reduction mill along a predetermined path via a conveyor means, protective apparatus for providing a signal indicative of the presence of the non-frangible foreign object at a predetermined location along the predetermined path, comprising:

at least one sensing surface for traversing the flow of reducible material in said reduction mill and for receiving impactions of reducible material and foreign objects;

means for mounting said at least one sensing surface in operative relationship to said conveyor means and including means for vibrationally isolating said sensing surface from said reduction mill;

piezoelectric transducer means attached to said at least one sensing surface for providing output signals representative of the impactions of the foreign objects and the reducible material;

means coupled to said piezoelectric transducer means for selecting said foreign object impact signal from other signals coupled thereto; and means coupled to said selection means responsive to said foreign object impact signal for generating a utilization signal useful for indicating the presence of said foreign object.

2. The apparatus according to claim 1 wherein said selection means includes filter means coupled to said transducer means for selecting electrical signals within a predetermined bandwidth; and said utilization signal generator means includes threshold comparator means coupled to said filter means for receiving the output signal of said filter means and for providing a signal representative of a foreign object in said reducible material when the output signal of said filter means exceeds a predetermined threshold value.

3. The apparatus according to claim 2 wherein said sensing surface includes a single bar disposed within the reduction mill and traversing the width of the reducible material flow.

4. The apparatus according to claim 2 wherein said sensing surface includes first and second bars for generating acoustic signals in response to impacts by said foreign object and said reducible material, each coupled to said piezolectric transducer means for conversion to electrical signals representative of said foreign object and reducible material impacts.

5. The apparatus according to claim 1 wherein said selection means includes first and second filter means coupled to said piezoelectric transducer means for providing electrical output signals; and said utilization signal generator means includes difference amplifier means coupled to receive said output signal from said first and second filter means for comparing said respective output signals and providing a signal representative of a foreign object in said reducible material.

6. The apparatus according to claim 5 wherein said sensing surface includes a single bar disposed within the conveyor means and traversing the width of the reducible material flow.

7. The apparatus according to claim 5 wherein said sensing surface includes first and second bars for generating acoustic signals in response to impacts by said foreign object and said reducible material, each coupled to said piezoelectric transducer means for conversion to electrical signals representative of said foreign object and reducible material impacts.

8. The apparatus according to claim 7 wherein said electrical signals representative of said foreign object impacts provide a control signal to said reduction mill for reversing the direction of at least one conveyor;

thereby conveying the flow of said material away from a hammer roll.

* * * * *